US006092514A

United States Patent [19]

Ruoff et al.

[11] Patent Number: 6,092,514

[45] Date of Patent: Jul. 25, 2000

[54] FUEL INJECTION SYSTEM FOR AN INTERNAL COMBUSTION ENGINE

[75] Inventors: Manfred Ruoff, Moeglingen; Horst Harndorf, Schwieberdingen, both of Germany

[73] Assignee: Robert Bosch GmbH, Stuttgart, Germany

[21] Appl. No.: 09/331,487

[22] PCT Filed: Jul. 22, 1998

[86] PCT No.: PCT/DE98/02056

§ 371 Date: Jun. 22, 1999

§ 102(e) Date: Jun. 22, 1999

[87] PCT Pub. No.: WO99/20892

PCT Pub. Date: Apr. 29, 1999

[30] Foreign Application Priority Data

Oct. 22, 1997 [DE] Germany ..... 197 46 489

[51] Int. Cl.[7] ..... F02B 13/00

[52] U.S. Cl. ..... 123/575; 123/447

[58] Field of Search ..... 123/575, 576, 123/577, 578, 467, 299, 300, 447

[56] References Cited

U.S. PATENT DOCUMENTS

| | | | |
|---|---|---|---|
| 5,174,247 | 12/1992 | Tosa | 123/575 |
| 5,438,966 | 8/1995 | Teegan | 123/299 |
| 5,529,024 | 6/1996 | Wirbeleit | 123/447 |
| 5,601,067 | 2/1997 | Wirbeleit | 123/300 |
| 5,651,346 | 7/1997 | Remmels | 123/447 |
| 5,722,377 | 3/1998 | Schoenfeld | 123/575 |
| 5,979,410 | 11/1999 | Grieshaber | 123/575 |

*Primary Examiner*—Carl S. Miller

*Attorney, Agent, or Firm*—Ronald E. Greigg; Edwin E. Greigg

[57] ABSTRACT

A fuel injection system with a common rail pressure reservoir which receives fuel at high pressure, and with a dual-substance nozzle for bifluid injection of fuel and a supplementary fluid into an intern combustion engine. The system includes a first 2/2-way valve (MV1) in the injection line between the common rail pressure reservoir and a pressure chamber surrounding the nozzle needle of the dual-substance nozzle, and a second 2/2-way valve (MV2), whose inlet communicates via a supply line with the injection line at a point between the first 2/2-way valve (MV1) and the pressure chamber (3.5), and whose outlet communicates with an outlet line on a fuel low-pressure side. The system is economical and at the same time, it becomes possible to shift the metering for supplementary fluid to a single metering valve that controls an entire group of injectors.

22 Claims, 3 Drawing Sheets

FUEL INJECTION SYSTEM FOR AN INTERNAL COMBUSTION ENGINE

PRIOR ART

The invention is based on a fuel injection system for an internal combustion engine for an internal combustion engine.

Such fuel injection systems are known for instance from German Patent DE 43 37 048 C2. In it, on the one hand a dual-substance nozzle is provided, which serves to provide layered injection of fuel and a supplementary fluid, such as Diesel fuel and water, in order to reduce pollutant emissions from the engine and optionally increase efficiency. On the other hand, in the known injection system the so-called common rail technique is realized, in which all the injection nozzles serving the engine are supplied with high-pressure fuel from a common rail pressure reservoir.

A disadvantage of the known fuel injection system is that for each individual injector, for metering the supplementary fluid, a complicated and relatively expensive 3/2-way valve is needed, and a further 3/2-way valve is needed to control the Diesel injection quantity. To prestore the supplementary fluid, the fuel delivery from the common rail pressure reservoir to the injection nozzle is interrupted with the first 3/2-way valve, and at the same time a pressure chamber, which surrounds the injection nozzle and in which fuel is stored at high pressure, is drained to the fuel low-pressure side through a corresponding position of the first 3/2-way valve. As a result of the attendant pressure drop in the pressure chamber, supplementary fluid is pumped into the pressure chamber via a suitable line and positively displaces the corresponding volume of fuel. After that, the first 3/2-way valve is returned to a position which establishes a communication between the common rail pressure reservoir and the pressure chamber in the injection valve. For accurate-quantity metering of the fuel quantity to be injected, which quantity should follow the prestored supplementary fluid in the injection surge brought about by the next valve opening, a further 3/2-way magnet valve is provided, which selectively connects the back side of the nozzle needle, which is held in the closing position by a spring, selectively with either the common rail pressure reservoir or the fuel low-pressure side and as a result controls the timing of the stroke of the valve needle, the opening and closing of the valve, and thus the desired injection quantity.

In principle, the known fuel injection system requires the two precise-action and thus complicated 3/2-way control magnet valves for each individual injector, so that the injector can precisely meter both the desired fuel quantity and the required quantity of supplementary fluid.

ADVANTAGES OF THE INVENTION

The fuel injection system of the invention, for the sake of structural simplification and thus more economical manufacture, has been set forth hereinafter. As a result, the two complicated and expensive 3/2-way magnet control valves can be replaced by simpler and less expensive 2/2-way valves, and at the same time the possibility is afforded of shifting the metering for the supplementary fluid to a single, precisely acting metering valve that is capable of serving an entire group of injectors. While the second 2/2-way valve determines only the opening and closing time for the supplementary fluid prestorage, the metering for the fuel quantity to be injected is accomplished by a suitable timing control of the first 2/2-way valve in the injection line between the common rail pressure reservoir and the pressure chamber.

In order to assure constant pressure conditions in the line system and, particularly also at high temperatures, to prevent outgassing of the supplementary fluid, as a rule water, when the boiling point is exceeded, it is recommended that a check valve be used between the second 2/2-way valve and the fuel low-pressure side.

It is also advantageous if the nozzle needle, at the blunt of its injector tappet, in the radial extension, has a small piston which protrudes into a chamber acted upon by high pressure from the common rail pressure reservoir, which chamber is in turn sealed off in pressureproof fashion from the chamber surrounding the nozzle needle. By exerting the common rail pressure on the constant piston area, the control motions of the nozzle needle in the injection event become independent from the absolute pressure conditions in the common rail pressure reservoir, because to move the injector tappet it is always the same resistance, namely the spring force of the valve spring, that has to be overcome, and thus the forces of motion remain constant. The result is constant switching times that are favorable from the standpoint of closed-loop control and that are determined by the respective motion time of the injector tappet.

An embodiment of the fuel injection system of the invention is especially preferred in which to pump the supplementary fluid a dividing piston adapter is used, which on the one hand is filled with supplementary fluid from a suitable supply container by a fill pump and on the other a driven, in metering fashion, by the operating fluid of a feed pump that is driven by the engine camshaft and, at a suitable crankshaft angle, effects the pumping of the operating fluid, as a rule Diesel fuel, but possibly also some other fluid with suitable lubricant properties.

In an advantageous refinement of this embodiment, the feed pump is embodied as a preferably electrically and/or hydraulically triggered adjusting pump, and quite particularly preferably as an adjustable ball rotor pump.

Ball rotor pumps are known per se from German Patent Disclosure DE 43 12 498 A1. However, the known ball rotor pump is not adjustable and therefore is unsuited to the above intended purpose. A ball rotor pump which includes an adjusting mechanism for adjusting the eccentricity "e" is therefore within the scope of the present invention.

In particular, it is advantageous if the ball rotor adjusting pump of the invention, in an inner pump housing receiving the rotor-ball, has an annular chamber which is divided by meridionally sealing ridges into a pressure chamber and an intake chamber and communicates with a feed bore or suction bore in the inner pump housing.

To enable an intake stroke on the part of the dividing piston of the dividing piston adapter, an additionally provided control slit in the hydraulic triggering mimic of the ball rotor adjusting pump is needed in the above-discussed application of the invention; this can be achieved by technologically simple means by suitable grooves in the rotor-ball that can cooperate with the intake chamber.

Further advantages and advantageous features of the subject of the invention can be learned from the specification, drawing and claims.

BRIEF DESCRIPTION OF THE DRAWINGS

Four exemplary embodiments of the fuel injection system according to the invention for internal combustion engines are shown in the drawings and will be described in the ensuing description.

DESCRIPTION OF THE EXEMPLARY EMBODIMENTS

Figure 1:
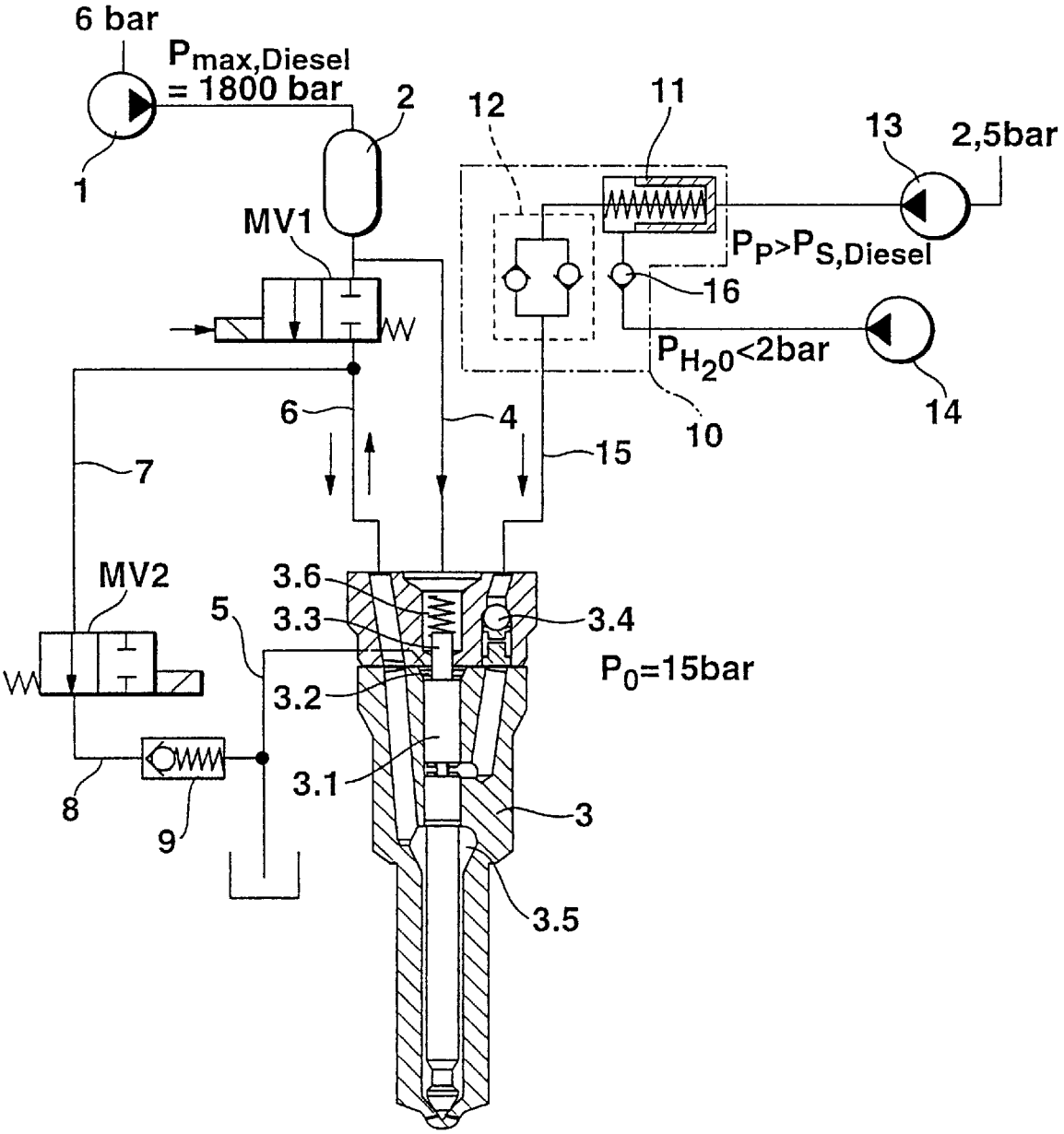
FIG. 1 illustrates a schematic wiring diagram of a first exemplary embodiment of the fuel injection system of the invention, with two 2/2-way valves for controlling the quantity of the pumping or injection of fuel and supplementary fluid through a dual-substance nozzle, shown schematically in longitudinal section; the supplementary fluid line to the dual-substance nozzle is supplied by a dividing piston system with an equal pressure valve assembly.

In the first exemplary embodiment shown in FIG. 1 of the fuel injection system according to the invention for an internal combustion engine, for bifluid injection of fuel (as a rule, Diesel fuel) and a supplementary fluid (as a rule, water), a high-pressure pump 1 supplies a common rail pressure reservoir 2 with fuel at a pressure level of approximately 1800 bar. Between the common rail pressure reservoir 2 and a pressure chamber 3.5 of an injection valve, which is to be supplied with fuel by the pressure reservoir 2 via an injection line 6 and which surrounds the nozzle needle 3.1 of a dual-substance nozzle 3, a quantity-metering component must now be disposed, because as noted the earlier typical, classical injection pump has been replaced by the combination of the common rail pressure reservoir 2 and the simpler high-pressure pump 2, and the tail pressure is always present at a certain level. This task is taken on by a first 2/2-way valve MV1 in the arrangement of the invention. This valve should be designed as a high-speed magnet valve with good replicability and a more or less smooth transition between the two extreme positions, because an injection quantity course may be needed that can be designed chronologically. The precise quantity metering is made possible via the known (measured or controlled) pressure drop between the common rail pressure reservoir 2 and the engine combustion chamber to be supplied by the dual-substance nozzle 3, by means of an accurate time slot, whose size depends on other influencing factors, via an electrical trigger which is not shown in the drawing.

The structure and mode of operation of the dual-substance nozzle 3 used is known, except for minor details, from the prior art. However, in the system of the invention, a small piston 3.3 is additionally provided on the blunt axial end of the nozzle needle (injector tappet) 3.1 remote from the tip of the nozzle needle; this piston, with its end remote from the nozzle needle 3.1, protrudes into a chamber 3.6 which communicates directly via a line 4 with the common rail pressure reservoir 2 and is acted upon by the high pressure prevailing there. As a result, it is substantially always the same resistance force that has to be overcome to move the injector tappet 3.1, since now, because of the constant piston area ratios and because the effects of the absolute pressure in the common rail pressure reservoir 2 are precluded, a pressure pulse from the (variable) rail pressure need merely overcome a constant spring pressure. Thus virtually constant switching times (motion time of the injector tappet) ensue, which are more welcome from the standpoint of control technology. For ventilating the chamber 3.2 that receives the blunt axial end of the nozzle needle 3.1 and that is sealed off for high pressure from the chamber 3.6, a vent line 5 leading to the fuel low-pressure side is provided.

For introducing supplementary fluid, it is now necessary, as is known per se in principle from the prior art, to open up a way for the fuel, to be positively displaced by the supplementary fluid, out of the dual-substance nozzle 3. This is accomplished by suitable wiring of a second 2/2-way valve MV2, whose inlet communicates with the injection line 6 via a supply line 7 and whose outlet communicates with the fuel low-pressure side via an outlet line 8. If supplementary fluid is to be added in metered fashion, then the first 2/2-way valve MV1 is closed and the second 2/2-way valve is switched open. As a result, fuel at high pressure escapes from the pressure chamber 3.5 to the fuel low-pressure side, as a rule the fuel tank, via the injection line 6, the supply line 7, the outlet line 8, and a check valve 9. As a result, supplementary fluid can flow into the pressure chamber 3.5 to replenish it via a check valve 3.4 (where $p_0$=15 bar) from a supplementary fluid line 15 leading to the dual-substance nozzle 3. The fluid-carrying bores of the dual-substance nozzle 3 and the line lengths, however, must be dimensioned in such a way and the lines installed in such a way that no supplementary fluid can reach the fuel tank. Before the actual invention event of the supplementary fluid, the correct quantity thereof must be metered and, while the system pressure is still low, pumped into the dual-substance nozzle 3. This is done by means of a so-called M pump 13, which pumps an operating fluid at a pilot pressure level of approximately 2.5 bar into a dividing piston adapter 10 that has a dividing piston 11 and an equal pressure valve 12. The dividing piston adapter 10 separates the operating fluid (as a rule, Diesel fuel) of the M pump 13 from the supplementary fluid (as a rule, water) to be introduced. The water side of a cylinder liner in the dividing piston 11 is supplied with supplementary fluid at low pressure (p<2 bar) by a fill pump 14 via a check valve 16. At the correct moment before the actual injection, that is, between the injection phases, a desired quantity of operating fluid is output by the M pump 13 to the dividing piston 11, at a higher pressure than that for which the check valve 3.4 of the dual-substance nozzle 3 is set. As a result, the quantity of supplementary fluid, which on the other side of the dividing piston 11 corresponds to the quantity of operating fluid of the M pump 13, is fed onward via the equal pressure valve 12 to the supplementary fluid line 15. The equal pressure valve 12 serves to relieve the pressure or supply the correct pilot pressure to the supplementary fluid line 15 between the dividing piston adapter 11 and the dual-substance nozzle 3.

The second 2/2-way valve MV2 can also be a relatively simple and more-economical valve than the first 2/2-way valve MV1, since for the function of positive displacement of fuel out of the pressure chamber 3.5 for the sake of prestoring supplementary fluid, the exactness of the first 2/2-way valve is not absolutely necessary, and only an unambiguous yes/no behavior of the valve MV2 is otherwise needed.

Figure 2:
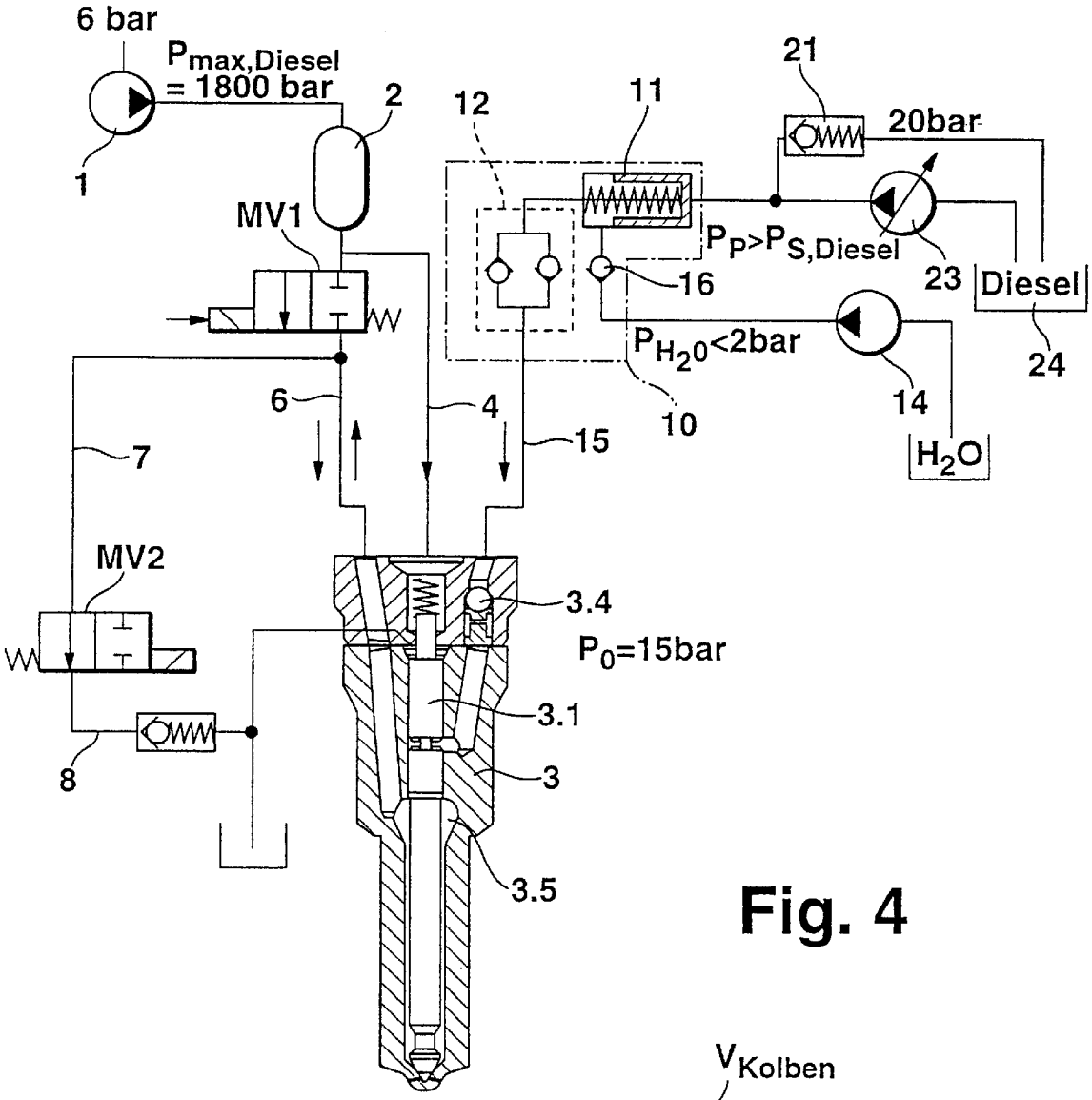
FIG. 2 illustrates a further, especially preferred exemplary embodiment, in which the M pump that supplied operating fluid to the dividing piston of the dividing piston adapter is replaced by a simpler low-pressure feed pump.

The second exemplary embodiment shown in FIG. 2 of the fuel injection system of the invention differs from that shown in FIG. 1 in that the expensive M pump is replaced by a considerably less expensive and more simply constructed adjusting pump 23. This pump is intended, like the M pump 13, to furnish quantity-metered operating fluid to the dividing piston 11 of the dividing piston adapter 10, but with the restriction that driving with the addition of supplementary fluid should be done only at a certain operating point of the internal combustion engine to be supplied. This operating point should be located within the full-load range of the engine, so that only during a certain crankshaft angle is an injection of supplementary fluid necessary. If the fixed crankshaft angle is also intended to fit a partial-load range, then if needed driving can be done with the addition of supplementary fluid then as well.

The quantity of operating fluid can be determined by the adjustability of the feed pump 23. If injection of supplementary fluid is not being employed, the adjusting pump 23 is set to "zero pumping", which is preferably done electrically or electrohydraulically. However, this adjustment should be capable of being done quickly enough to suit the demands of the driver and the required driving dynamics when used in an internal combustion engine in a vehicle. This adjusting mechanism should therefore also be capable of providing adjustment pumping during the metering phase of supplementary fluid, or in other words during the operation of the feed pump 23. Hence the adjusting mechanism should be embodied robustly enough.

The possibility is also thus obtained, with an adjusting pump 23 and by means of inlet and outlet slits positioned precisely at the correct angular position relative to the suitable crankshaft angle, for instance in the range of the highest pump piston speed, to output the quantity of operating fluid at the dividing piston 11 of the dividing piston adapter 10 that corresponds to the desired pump adjustment. The outlet slits of the adjusting pump 23 can therefore also be replaced with check valves, so that slit control, which is complicated, is not necessary, yet a return flow of operating fluid during the intake phase of the dividing piston 11 is still prevented.

To enable forcing the metering volume of operating fluid placed previously in the dividing piston adapter 10 back into the intake zone of the adjusting pump 23, an additionally mounted control slit is needed in the hydraulic triggering mimic of the adjusting pump. The M pump 13 shown in FIG. 1 accomplishes this via suitable bores that are overtaken by the pump piston.

For overload protection, a safety valve 21 is disposed in a line that branches off from the connection between the feed pump 23 and the dividing piston adapter 10 and leads into a container 24 of operating fluid.

Figure 3A:
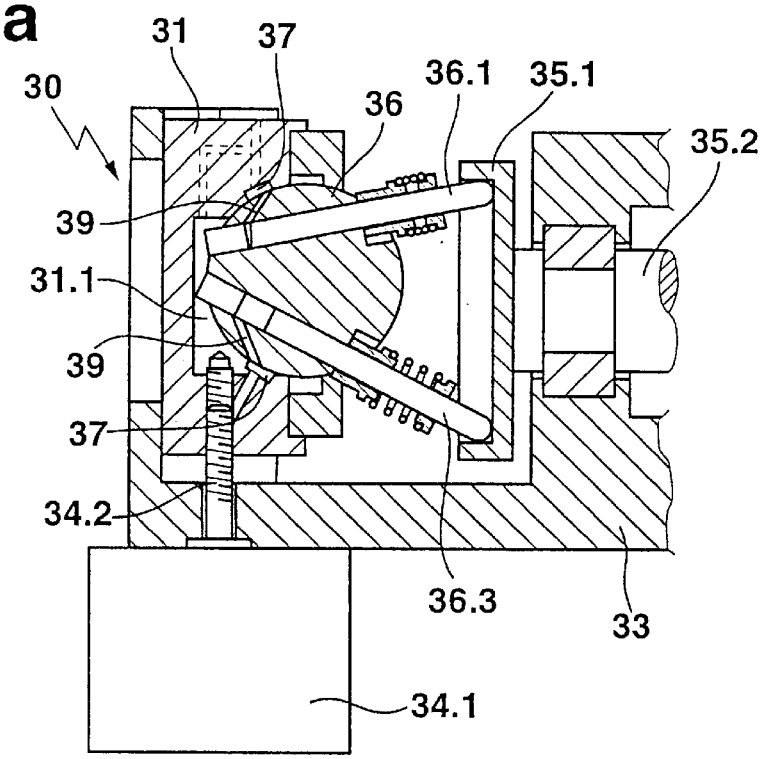
FIG. 3*a* illustrates a vertical section through an adjustable ball rotor pump which can be employed as a feed pump in the arrangement of FIG. 2.
Figure 3B:
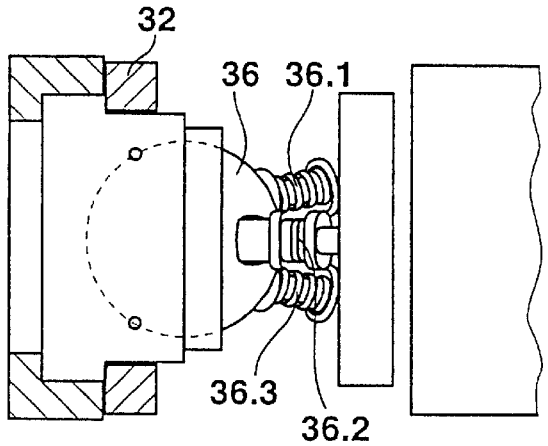
FIG. 3*b* illustrates a plan view, partly in section, on the ball rotor pump of FIG. 3*a;*
Figure 3C:
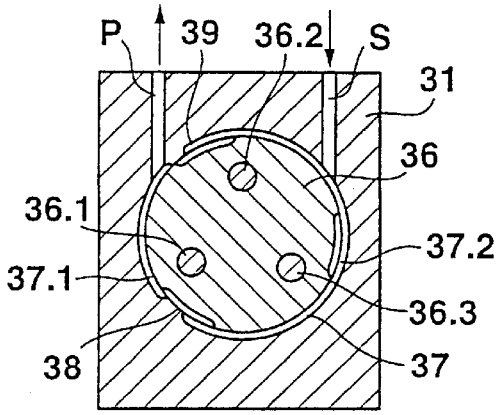
FIG. 3*c* illustrates a dogleg sectional view of a portion of the ball rotor pump taken along the lines A–B in FIG. 3*a*.

The adjustable ball rotor pump 30 shown in various sectional views in FIGS. 3*a*–3*c* is especially highly suitable for use as an adjusting pump 23 in the fuel injection system of FIG. 2. Here a rotor-ball 36 is rotatably received in a recess in an inner pump housing 31, which is accommodated longitudinally movably in a guide 32 and can come to a stop against an outer housing 33. When the inner pump housing 31 comes to a stop against the outer housing 33, the eccentricity "e" shown in the drawing should be approximately zero.

The adjustability of the ball rotor pump 30 is provided by an electric motor 34.1, which via a threaded spindle 34.2 that is supported in the inner pump housing 31 moves this pump housing back and forth relative to the outer housing 33 and in the process varies the eccentricity "e", thus resulting in different supply quantities of the pump.

The ball rotor pump 30 is driven via a drive shaft 35.2, coupled at a rigid angle to the engine camshaft, and on the end of the drive shaft inside the outer housing 33 in which the drive shaft 35.2 is rotatably supported, a slaving flange 35.1 is attached, again at a fixed angle. Reciprocating pistons 31.1, 31.2, 31.3 (in the exemplary embodiment, three of them) are supported in this slaving flange 35.1 and are received longitudinally movably in the rotor-ball 36.

If the eccentricity "e" is finite, that is, upon a parallel displacement of the axis of the drive shaft 35.2 and of the rotor-ball 36, the pistons 36.1–36.3, upon rotation of the slaving flange 35.1, not only carry the rotor-ball 31 along with them in a rotary motion but also still for a long time execute an individual reciprocating motion that is precisely defined by the eccentricity "e", so that suitable pressure surges in the operating fluid are effected inside a pressure chamber 31.1 in the inner pump housing 31.

If, as proposed above, upon contact of the longitudinally movable inner pump housing 31 with the outer housing 33 the eccentricity "e" is zero at that precise time, then no reciprocating motions of the reciprocating pistons 36.1–36.3 occur upon rotation of the slaving flange 35.1. In that position, the electrical triggering of the electric motor 34.1 can be set to zero.

The number of reciprocating pistons 36.1–36.3 determines the number of groups of injectors that according to the invention can each be supplied with supplementary fluid via an individual dividing piston adapter 11 by the adjustable ball rotor pump 30.

The hydraulic slit control of the ball rotor adjusting pump 30 is designed by dividing an annular chamber 37, which is formed by an annular groove in the recess of the inner pump housing 31 that receives the rotor-ball 36, into a pressure chamber 37.1 in the region of the greatest reciprocating piston speed and an intake chamber 37.2. The pressure chamber 37.1 is partitioned off from the intake chamber 37.2 by meridionally sealing ridges 38. The ridges 38, at their line of contact with the rotor-ball 36, have fine volume-relief grooves, not shown in the drawing for the sake of simplicity, that are continuous over virtually the entire circumferential length of the ridges 38. As a result, upon rotation of the rotor-ball 36, the reciprocating pistons 36.1–36.3 can pump continuously, without causing jerking motions during pump operation.

Once bottom dead center is exceeded, the reciprocating pistons 36.1–36.3 can admittedly aspirate no further operating fluid, but can pump it back into the intake chamber 37.2 as far as the range of the first ridge 38 (in terms of the direction of motion of the rotor revolution). When the first ridge 38 is overtaken, the respective reciprocating piston can supply a genuine supply quantity and can then continue to output it to the dividing piston 11.

In order to give the dividing piston 11 freedom for its intake stroke, the propellant volume output by the adjusting pump to the dividing piston 11 can flow back again. To that end, grooves 39 are let into suitable points on the rotor-ball 36; during the revolution of the rotor-ball 36, they make it possible for the propellant volume pumped to be forced back, at the correct moment and over the correct length of time, from the side of the dividing piston 11 triggered by the adjusting pump 30 into a suction bore S communicating with the intake chamber 37.2, for the sake of the intake stroke of the dividing piston. The grooves 39 may for instance be created by plunge-cut grinding at the appropriate points on the rotor-ball 36.

Figure 4:
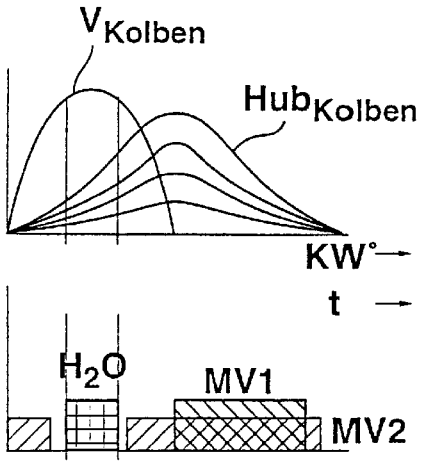
FIG. 4 illustrates a schematic course of the time and crankshaft angle of the volume positively displaced by the piston of the feed pump and of the piston stroke (top) and the corresponding prestorage of supplementary fluid ($H_2O$) and the switching times of the 2/2-way valves MV1 and MV2.

The graph in FIG. 4, as a function of time and of the crankshaft angle, in its upper half shows the volume of operating fluid positively displaced by the reciprocating pistons 36.1–36.3 and the corresponding piston stroke at different settings of the eccentricity "e", and in its lower portion, it shows the sequence over time of the prestorage of operating fluid ($H_2O$) and the corresponding switching activities of the 2/2-way valves Mv1 and Mv2.

The foregoing relates to a preferred exemplary embodiment of the invention, it being understood that other variants and embodiments thereof are possible within the spirit and scope of the invention, the latter being defined by the appended claims.

What is claimed is:

1. A fuel injection system for an internal combustion engine, comprising a high-pressure pump (1) for pumping the fuel via an injection line (6) into a dual-substance nozzle (3), a pumping device for pumping a quantity of supplementary fluid, carried via a check valve (3.4), into a supplementary fluid line (15) leading to the dual-substance nozzle (3), said supplementary fluid line (15) communicates with a pressure chamber (3.5) surrounding a nozzle needle (3.1) of the dual-substance nozzle (3), a valve assembly for prestoring the supplementary fluid quantity in the dual-substance nozzle (3), wherein the opening and closing of the nozzle needle (3.1) is effected by a pressure of a common rail pressure reservoir (2) filled with fuel at high pressure, the valve assembly is disposed at least partly in the injection line (6), and when the supplementary fluid is prestored, the fuel delivery to the injection nozzle (3) is interrupted and the pressure chamber (3.5) is made to communicate with a fuel low-pressure side, and otherwise the communication with the fuel low-pressure side is interrupted and the pressure chamber (3.5) is acted upon by high-pressure fuel, a first 2/2-way valve (MV1) in the injection line (6) between the common rail pressure reservoir (2) and the pressure chamber (3.5) and a second 2/2-way valve (MV2), whose inlet communicates via a supply line (7) with the injection line (6) at a point between the first 2/2-way valve (MV1) and the pressure chamber (3.5), and whose outlet communicates with the fuel low-pressure side via an outlet line (8), are provided.

2. The fuel injection system according to claim 1, in which a check valve (9) is provided in the outlet line (8) between the second 2/2-way valve (MV2) and the fuel low-pressure side.

3. The fuel injection system according to claim 1, in which on a blunt axial end of the nozzle needle (3.1) remote from the nozzle needle tip, a piston (3.3), in its axial extension, is connected firmly to the nozzle needle (3.1), which piston protrudes with an axial end remote from the nozzle needle (3.1) into a chamber (3.6) which is sealed off in pressureproof fashion from the chamber (3.2) of the dual-substance nozzle (3) that receives the blunt axial end of the nozzle needle (3.1) and is acted upon by the high pressure prevailing in the common rail pressure reservoir (2).

4. The fuel injection system according to claim 3, in which the chamber (3.2) receiving the blunt axial end of the nozzle needle (3.1) communicates with the fuel low-pressure side via a vent line (5).

5. The fuel injection system according to claim 1, in which the supplementary fluid line (15) leading to the dual-substance nozzle (3) discharges at another end in a dividing piston adapter (10), which includes a dividing piston (11), one side of said dividing piston is supplied with an operating fluid by a feed pump (13; 23; 30) and whose other side is supplied with supplementary fluid by a fill pump (14), and also includes an equal pressure valve (12).

6. The fuel injection system according to claim 5, in which a line provided with a safety valve (21) branches off from the line between the feed pump (13; 23; 30) and the dividing piston adapter (10) and discharges into a container (24) of operating fluid.

7. The fuel injection system according to claim 5, in which the feed pump (23; 30) has a drive connection to the face end of a camshaft of the engine.

8. The fuel injection system according to claim 6, in which the feed pump (23; 30) has a drive connection to the face end of a camshaft of the engine.

9. The fuel injection system according to claim 5, in which the feed pump (23; 30) is an adjusting pump, which is triggered electrically and/or hydraulically.

10. The fuel injection system according to claim 9, in which the adjusting pump has check valves instead of outlet slits.

11. The fuel injection system according to claim 9, in which the adjusting pump has a hydraulic triggering mimic with an additional control slit, which enables a return flow of operating fluid into the adjusting pump during an intake stroke of the dividing piston (11).

12. The fuel injection system according to claim 10, in which the adjusting pump has a hydraulic triggering mimic with an additional control slit, which enables a return flow of operating fluid into the adjusting pump during an intake stroke of the dividing piston (11).

13. The fuel injection system according to claim 9, in which the adjusting pump (23; 30) includes an inner pump housing (31), which is accommodated longitudinally movably in a guide (32), and that an outer housing (33) surrounding the pump housing (31) is provided, against which the movable pump housing (31) can come to a stop in an end position.

14. The fuel injection system according to claim 13, in which an electric motor (34.1) is provided, which can effect the adjustment of the feed pump (23; 30) by driving a threaded spindle (34.2) supported in the pump housing (31).

15. The fuel injection system according to claim 13, in which the feed pump (23; 30) is an adjustable ball rotor pump.

16. The fuel injection system according to claim 15, in which the ball rotor adjusting pump (30) includes a rotor ball (36), which is rotatably received in a recess of the inner pump housing (31) and in turn longitudinally movably receives at least one reciprocating piston (36.1 and 36.3), which is supported on one end via balls in a slaving flange (35.1) that is rigidly coupled to a rotatable drive shaft (35.2), and on another end protrudes into a pressure chamber (31.1) in the inner pump housing (31); that the inner pump housing (31), in the recess, has an annular chamber (37) which is formed by an annular groove and is divided by meridionally sealing ridges (38) into a pressure chamber (37.1) and an intake chamber (37.2), and that the pressure chamber (37.1) communicates with a feed bore (P) and the intake chamber (37.2) communicates with a suction bore (S) in the inner pump housing (31).

17. The fuel injection system according to claim 16, in which the ridges (38) have fine volume relief grooves that are continuous over virtually the entire circumferential length of the ridges (38).

18. The fuel injection system according to claim 11, in which grooves (39) are let into the rotor-ball (36), which given a suitable position of the rotor-ball (36), cooperates with the intake chamber (37.2).

19. A method for operating a fuel injection system to pump a supplementary fluid which comprises coupling a drive connection of a feed pump to a certain camshaft angle in a full-load range of an engine to bring about pumping of a supplementary fluid.

20. A method according to claim 19, in which a pumping of supplementary fluid is brought about in a partial-load range of the engine by the feed pump (23; 30), if the fixed camshaft angle fits the feed pump.

21. The method according to claim 19, which comprises setting adjusting pump (23; 30) to zero pumping, when a supplementary fluid injection is not employed.

22. A fuel injection system as set forth in claim 10, which includes a ball rotor pump (30) that includes an adjusting device for adjusting an eccentricity (e).

* * * * *